US010895269B2

(12) United States Patent
Hanusovsky et al.

(10) Patent No.: US 10,895,269 B2
(45) Date of Patent: Jan. 19, 2021

(54) DOUBLE ACTING HYDRAULIC PRESSURE INTENSIFIER

(71) Applicant: PistonPower ApS, Soenderborg (DK)

(72) Inventors: Juraj Hanusovsky, Povazska Bystrica (SK); Jorgen Mads Clausen, Soenderborg (DK); Tom Tychsen, Graasten (DK)

(73) Assignee: PISTONPOWER APS, Sønderborg (DK)

( * ) Notice: Subject to any disclaimer, the term of this patent is extended or adjusted under 35 U.S.C. 154(b) by 316 days.

(21) Appl. No.: 15/909,222

(22) Filed: Mar. 1, 2018

(65) Prior Publication Data

US 2018/0252242 A1 Sep. 6, 2018

(30) Foreign Application Priority Data

Mar. 3, 2017 (EP) ..... 17159047

(51) Int. Cl.

| | |
|---|---|
| ***F15B 3/00*** | (2006.01) |
| ***F04B 9/113*** | (2006.01) |
| *F04B 53/14* | (2006.01) |
| *F04B 7/02* | (2006.01) |

(52) U.S. Cl.

CPC ..... *F15B 3/00* (2013.01); *F04B 9/113* (2013.01); *F04B 7/0225* (2013.01); *F04B 53/144* (2013.01)

(58) Field of Classification Search

CPC ..... F15B 3/00; F04B 9/113
USPC ..... 417/225
See application file for complete search history.

(56) References Cited

U.S. PATENT DOCUMENTS

| | | | |
|---|---|---|---|
| 2,296,647 | A | 12/1942 | McCormick |
| 2,508,298 | A | 5/1950 | Saari |
| 2,991,130 | A | 7/1961 | Sampietro |
| 3,037,488 | A | 6/1962 | Barrett |
| 3,079,864 | A | 3/1963 | Drutchas et al. |
| 3,081,706 | A | 3/1963 | Drutchas et al. |
| 3,241,463 | A | 3/1966 | Barrett |

(Continued)

FOREIGN PATENT DOCUMENTS

| | | | |
|---|---|---|---|
| CN | 203348188 | U | 12/2013 |
| CN | 103511382 | A | 1/2014 |

(Continued)

OTHER PUBLICATIONS

First Examination Report for Indian Serial No. 201814004324 dated Feb. 28, 2020.

*Primary Examiner* — Peter J Bertheaud
(74) *Attorney, Agent, or Firm* — McCormick, Paulding & Huber PLLC

(57) ABSTRACT

A double acting hydraulic pressure intensifier (1) is described comprising a housing (2), a first piston arrangement (7) having a first high pressure piston (8) in a first high pressure chamber (3) in the housing (2) and a first low pressure piston (9) in a first low pressure chamber (5) of the housing (2), a second piston arrangement (10), having a second high pressure piston (11) in a second high pressure chamber (4) in the housing (2) and a second low pressure piston (12) in a second low pressure chamber (6) in the housing (2), and a switching valve (14) having a valve element (15). Such a pressure intensifier should be made compact. To this end the switching valve (14) is located between the first piston arrangement (7) and the second piston arrangement (10).

19 Claims, 1 Drawing Sheet

(56) References Cited

U.S. PATENT DOCUMENTS

| | | | | |
|---|---|---|---|---|
| 3,391,538 | A | 7/1968 | Orloff et al. | |
| 3,579,985 | A | 5/1971 | Barrett | |
| 3,583,832 | A * | 6/1971 | Lee, II | F01L 23/00 417/225 |
| 3,632,230 | A * | 1/1972 | Ueda | F01L 21/00 417/225 |
| 3,835,752 | A | 9/1974 | D'Amata | |
| 4,281,587 | A | 8/1981 | Garcia-Crespo | |
| 4,523,895 | A * | 6/1985 | Silva | F04B 9/115 417/225 |
| 4,627,794 | A * | 12/1986 | Silva | F04B 9/115 417/225 |
| 4,659,294 | A | 4/1987 | Barthomeuf | |
| 4,780,064 | A | 10/1988 | Olsen | |
| 6,497,558 | B1 | 12/2002 | Hale | |
| 6,619,243 | B2 | 9/2003 | Al-Hawaj | |
| 6,866,485 | B2 | 3/2005 | Hansen et al. | |
| 7,726,950 | B2 | 6/2010 | Hansen et al. | |
| 8,613,602 | B2 | 12/2013 | Iversen | |
| 2003/0097924 | A1 | 5/2003 | Hansen et al. | |
| 2003/0172652 | A1 | 9/2003 | Tohru | |
| 2004/0006983 | A1 | 1/2004 | Sawdon | |
| 2004/0115070 | A1 | 6/2004 | Baatrup et al. | |
| 2005/0013716 | A1 | 1/2005 | Magami et al. | |
| 2005/0123416 | A1 | 6/2005 | Smith | |
| 2006/0073037 | A1 | 4/2006 | Pedersen et al. | |
| 2009/0317267 | A1 | 12/2009 | Gill et al. | |
| 2014/0373524 | A1 | 12/2014 | Schuller et al. | |
| 2016/0053749 | A1 | 2/2016 | Hunter | |
| 2018/0252206 | A1 | 9/2018 | Krissak et al. | |
| 2018/0252240 | A1 | 9/2018 | Vokel et al. | |
| 2018/0252241 | A1 | 9/2018 | Todsen et al. | |

FOREIGN PATENT DOCUMENTS

| | | | |
|---|---|---|---|
| CN | 203757349 | U | 8/2014 |
| DE | 3032430 | A1 | 3/1982 |
| DE | 102007031166 | A1 | 1/2009 |
| EP | 0692072 | B1 | 9/1999 |
| JP | S6224001 | A | 2/1987 |
| JP | S63243464 | A | 10/1988 |
| RU | 2056550 | C1 | 3/1996 |
| RU | 19404 | U1 | 8/2001 |
| RU | 24520 | U1 | 8/2002 |
| RU | 2513060 | C1 | 4/2014 |
| SU | 638751 | A1 | 12/1978 |
| SU | 1165818 | A1 | 7/1985 |

* cited by examiner

DOUBLE ACTING HYDRAULIC PRESSURE INTENSIFIER

CROSS-REFERENCE TO RELATED APPLICATION

This application claims foreign priority benefits under U.S.C. § 119 to European Patent Application No. 17159047.4 filed on Mar. 3, 2017, the content of which is hereby incorporated by reference in its entirety.

TECHNICAL FIELD

The present invention relates to a double acting hydraulic pressure intensifier comprising a housing, a first piston arrangement having a first high pressure piston in a first high pressure chamber in the housing and a first low pressure piston in a first low pressure chamber of the housing, a second piston arrangement having a second high pressure piston in a second high pressure chamber in the housing and a second low pressure piston in a second low pressure chamber in the housing, and a switching valve having a valve element.

BACKGROUND

The two piston arrangements move together. In one direction of movement the first piston arrangement performs a working stroke in which hydraulic fluid under an increased pressure is outputted out of the first high pressure chamber. In the other direction of movement the hydraulic fluid with increased pressure is outputted from the second high pressure chamber. The movement is caused by respective low pressures acting in the respective low pressure chambers. The pressure in the low pressure chambers is controlled by the switching valve.

SUMMARY

The object underlying the present invention is to make a double acting hydraulic pressure intensifier compact.

This object is solved with a double acting hydraulic pressure intensifier as described at the outset in that the switching valve is located between the first piston arrangement and the second piston arrangement.

Such a hydraulic pressure intensifier can be made compact since the switching valve can be integrated into the housing.

In an embodiment of the invention the valve element is arranged coaxial with at least one of the piston arrangements. A consequence of such an embodiment is that the valve element and the respective piston arrangement move along the same axis. Forces resulting from an acceleration of the respective piston arrangements and the valve element occur in one direction only.

In an embodiment of the invention the valve element has at least over a part of its length an outer diameter which is equal to an outer diameter of at least one of the low pressure pistons. This simplifies the construction. A bore accommodating the low pressure piston can be machined together with a bore accommodating the valve element.

In an embodiment of the invention a connecting rod is located between the two piston arrangements. This is a simple way to synchronize the movement of the piston arrangements without increasing dramatically the mass of the piston arrangements.

In an embodiment of the invention the connecting rod runs through the valve element. The valve element in this case is in form of a hollow sleeve which has the additional advantage that the mass of the valve element can be kept small.

In an embodiment of the invention a movement of the first piston arrangement in a direction to decrease the volume of the first high pressure chamber is caused by a pressure in the second low pressure chamber and a movement of the second piston arrangement in a direction to decrease the volume of the second high pressure chamber is caused by a pressure in the first low pressure chamber. The two piston arrangements work together in the sense that one piston arrangement is loaded with a low pressure and the other piston arrangement generates the high pressure. Furthermore, the two piston arrangements and the rod are pressed together by the respective pressures.

In an embodiment of the invention in any switching position of the switching valve a space between the two piston arrangements is connected to a tank port. This space is loaded by a low pressure only.

In an embodiment of the invention the space is of constant volume. Therefore, no hydraulic fluid has to be displaced out of the space which keeps hydraulic losses low.

In an embodiment of the invention the valve element comprises a first pressure area arrangement and a second pressure area arrangement, wherein an effective area of the first pressure area arrangement is larger than an effective area of the second pressure area arrangement, the second pressure area arrangement is permanently loaded by a first pressure and the first pressure area arrangement is alternatively loaded by the first pressure and by a second pressure smaller than the first pressure. By changing the pressure acting on the first pressure area arrangement it is possible to change the switching position of the valve element.

In an embodiment of the invention the housing comprises a switching channel connected to the first pressure area arrangement, wherein the switching channel has a first opening connectable to the first pressure and a second opening connectable to the second pressure, wherein upon movement the first piston arrangement covers and releases the first opening and the second opening. The first piston arrangement controls the position of the valve element by means of hydraulic pressures.

In an embodiment of the invention both openings are closed during a part of the movement. During this part no pressure changes occur. This makes operation stable.

BRIEF DESCRIPTION OF THE DRAWINGS

An embodiment of the invention will now be described in more detail with reference to the drawing, wherein.

DETAILED DESCRIPTION

Figure 1:
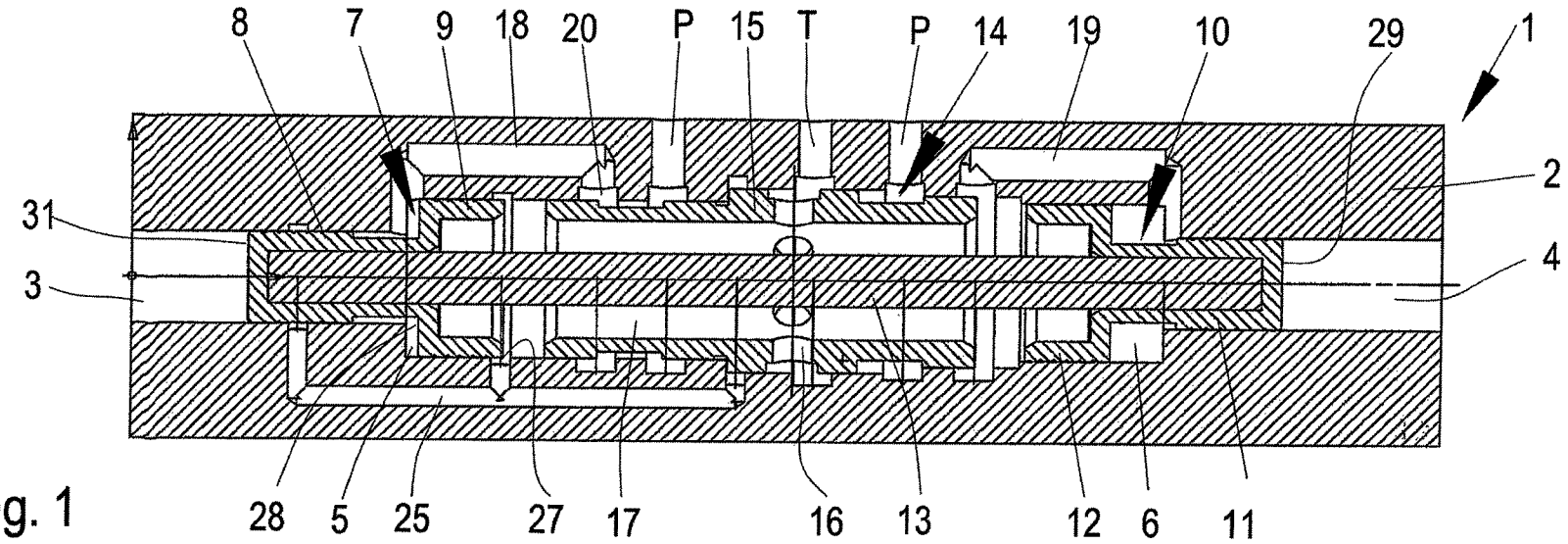
FIG. 1 shows a schematic longitudinal section of a double acting hydraulic pressure intensifier.

A double acting hydraulic pressure intensifier 1 comprises a housing 2 having two supply pressure ports P and a tank port T.

The housing comprises a first high pressure chamber 3 and a second high pressure chamber 4. Furthermore, the housing comprises a first low pressure chamber 5 and a second low pressure chamber 6.

A first piston arrangement 7 comprises a first high pressure piston 8 and a first low pressure piston 9. The first high pressure piston 8 is moveable in the first high pressure chamber 3 to decrease the volume of the high pressure chamber 3 when moved in one direction and to increase the volume of the first high pressure chamber 3 when moved in the opposite direction. A second piston arrangement 10 comprises a second high pressure piston 11 and a second low pressure piston 12. The second high pressure piston 11 is moveable in the second high pressure chamber 4 increasing a volume of the second high pressure chamber 4 when moving in one direction (to the right in FIG. 1) and increasing the volume of the second high pressure chamber 4 when moving in the opposite direction.

The two piston arrangements 7, 10 are connected by means of a connecting rod 13. As will be explained later it is not absolutely necessary to fix the connecting rod 13 to the piston arrangements 7, 10. The piston arrangements 7, 10 and the connecting rod 13 are held together by the pressures acting in the pressure chambers 3-6.

A switching valve 14 comprising a valve element 15 is arranged between the first piston arrangement 7 and the second piston arrangement 10. The valve element 15 is hollow. Therefore, the connecting rod 13 is guided or passes through the valve element 15.

The valve element 15 comprises a number of openings 16 through which the pressure at the tank port reaches a space 17 between the two piston arrangements 7, 10. A pressure at the tank port T is briefly termed "tank pressure". The pressure at the supply pressure port P is briefly termed "supply pressure".

The housing 2 comprises a first low pressure channel 18 and a second low pressure channel 19. The first low pressure channel 18 is connected to the first low pressure chamber 5 and the second low pressure channel 19 is connected to the second low pressure chamber 9.

The valve element 15 comprises a groove 20 connecting in a first switching position of the switching valve 14 the first low pressure channel 18 with one of the supply pressure ports P. This first switching position is shown in FIG. 1.

Figure 2:
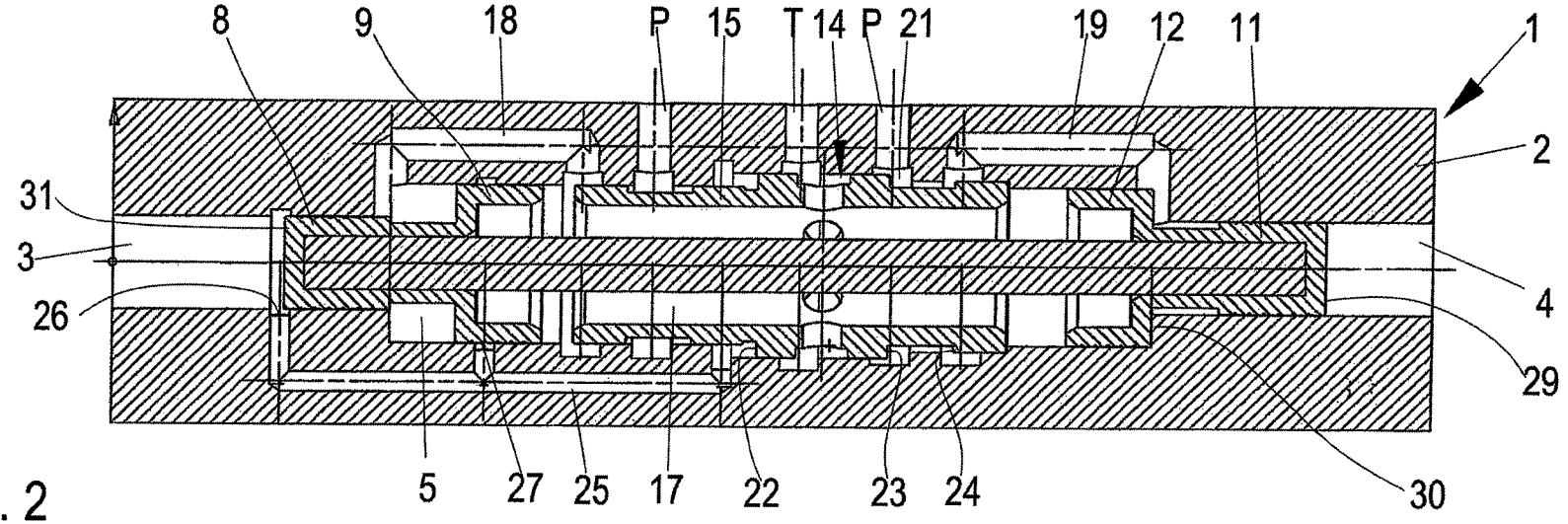
FIG. 2 shows a schematic longitudinal section of the pressure intensifier of FIG. 1 with some parts in another position.

The valve element 15 furthermore comprises a second groove 21 connecting in a second switching position of the valve element 15 the other supply pressure port P with the second low pressure chamber 19. This second switching position is shown in FIG. 2.

The valve element 15 comprises a first pressure area arrangement having basically a first pressure area 22. Furthermore, the valve element 15 comprises a second pressure area arrangement having two oppositely directed pressure areas 23, 24. The pressure areas 22, 23 are of equal size. However, a pressure acting on the pressure area 23 acts on the pressure area 24 in opposite direction so that the effective area of the second pressure area arrangement 23, 24 is smaller than the effective area of the first pressure area arrangement 22.

A switching channel 25 is provided in the housing 2. A pressure in the switching channel 25 acts on the first pressure area 22. The switching channel has a first opening 26 which opens into the first high pressure chamber 3. Furthermore, the switching channel 25 has a second opening 27 which opens into space 17.

In the switching position of the valve element 15 shown in FIG. 1 the first opening 26 is closed by the first high pressure piston 8 and the second opening 27 is open. In this case the first pressure area 22 is loaded by the pressure in space 17 which is equal to the tank pressure, i.e. a low pressure. The supply pressure from the supply pressure port P acts on the second pressure area arrangement 23, 24. The valve element 15 is shifted in the position shown in FIG. 1.

In this position supply pressure from the left supply pressure port P reaches the first low pressure chamber 5. The supply pressure loads a first low pressure area 28 of the first low pressure piston 9. The first low pressure area 28 is larger than a second high pressure area 29 of the second high pressure piston 11. Therefore, the first low pressure piston 9 generates a force shifting the second high pressure piston 11 by means of the connecting rod 13 in a direction to decrease the volume of the second high pressure chamber 4 and to increase the pressure of the hydraulic fluid in the high pressure chamber 4. The fluid with increased pressure is outputted from the high pressure chamber 4 by means of a check valve (not shown).

When the second high pressure piston 11 has decreased the volume of the second high pressure chamber 4 almost to a minimum the first low pressure piston 9 closes the second opening 27 to interrupt a connection between the first pressure area 22 of the valve element 15 and the space 17. After a further movement of the first piston arrangement 7 the first high pressure piston 8 opens the opening 26. At this moment hydraulic pressure from the first high pressure chamber 3 enters the switching channel 25 and is guided to the first pressure area 22. Since the effective area of the first pressure area 22 is larger than the effective area of the second pressure areas 23, 24, the valve element 15 is shifted to its other switching position. This is possible since the first pressure area 22 and the second pressure area arrangement 23, 24 are loaded by the same pressure, i.e. the supply pressure of supply pressure P, which is a higher pressure than the tank pressure. In a way not shown the two high pressure chambers 3, 4 are connected to the supply pressure port P by means of check valves.

When valve element 15 of the switching valve 14 is in the second switching position shown in FIG. 2 the second low pressure chamber 6 is filled with supply pressure from the supply pressure port P via the second low pressure channel 19. The pressure in the low pressure chamber 6 acts on a low pressure area 30 of the second low pressure piston 12. This second low pressure area 30 is larger than a first high pressure area 31 of the first high pressure piston 8 in a first high pressure chamber 3 so that the pressure in the second low pressure chamber 6 moves the second piston arrangement 10 to the left (as shown in FIG. 2). The first high pressure piston 8 decreases the volume of the first high pressure chamber 3 and increases the pressure of fluid in the first high pressure chamber 3 which is outputted via a check valve (not shown).

During the movement of the first high pressure piston 8 the first opening 26 is closed by the first high pressure piston 8. When moving further, the first low pressure piston 9 opens the opening 27 and the pressure in the switching channel 25 is lowered to the tank pressure. At this moment the force generated by the supply pressure on the second pressure area arrangement 23, 24 is larger than the force generated by the tank pressure on the first pressure area 22. Consequently, the valve element 15 is shifted to its other switching position to arrive back at the position shown in FIG. 1.

The two piston arrangements 7, 10 are always loaded with pressures acting against each other so that the piston arrangements 7, 10 are pressed on the connecting rod 13 and no further connection is necessary.

The valve element 15 is arranged coaxially with at least one of the piston arrangements 7, 10, preferably coaxially arranged with both piston arrangements 7, 10. The valve element 15 has at least over a part of its length the same outer diameter as at least one of the low pressure pistons 9, 12, preferably the same outer diameter as both of the low pressure pistons 9, 12.

The volume of the space 17 between the two piston arrangements 7, 10 is constant. Therefore, it is not necessary to move hydraulic fluid out of the space 17 or into the space keeping losses small.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A double acting hydraulic pressure intensifier comprising:

a housing, the housing being formed from a body having formed therein a first high pressure chamber, a first low pressure chamber, a second high pressure chamber, a second low pressure chamber, and a valve chamber, a first piston arrangement having a first high pressure piston in the first high pressure chamber in the housing and a first low pressure piston in the first low pressure chamber of the housing, a second piston arrangement, having a second high pressure piston in the second high pressure chamber in the housing and a second low pressure piston in the second low pressure chamber in the housing, and a switching valve located in the valve chamber of the housing between the first piston arrangement and the second piston arrangement, the switching valve having a valve element having, at least over a part of its length, an outer diameter which is equal to an outer diameter of at least one of the low pressure pistons, the valve element interacting with the housing to selectively open and close pressure ports formed through the body of the housing, wherein the valve element comprises a first pressure area arrangement and a second pressure area arrangement, wherein an effective area of the first pressure area arrangement is larger than an effective area of the second pressure area arrangement, the second pressure area arrangement is permanently loaded by a first pressure and the first pressure area arrangement is alternatively loaded by the first pressure and by a second pressure smaller than the first pressure.

2. The pressure intensifier according to claim 1, wherein the valve element is arranged coaxial with at least one of the piston arrangements.

3. The pressure intensifier according to claim 1, wherein a connecting rod is located between the first piston arrangement and the second piston arrangement.

4. The pressure intensifier according to claim 3, wherein the connecting rod runs through the valve element.

5. The pressure intensifier according to claim 1, wherein a movement of the first piston arrangement in a direction to decrease the volume of the first high pressure chamber is caused by a pressure in the second low pressure chamber and movement of the second piston arrangement in a direction to decrease the volume of the second high pressure chamber is caused by a pressure in the first low pressure chamber.

6. The pressure intensifier according to claim 1, wherein, in any switching position of the switching valve, a space between the first piston arrangement and the second piston arrangement is connected to a tank port (T).

7. The pressure intensifier according to claim 6, wherein the space is of constant volume.

8. The pressure intensifier according to claim 1, wherein the housing comprises a switching channel connected to the first pressure area arrangement, wherein the switching channel has a first opening connectable to the first pressure and a second opening connectable to the second pressure, wherein upon movement the first piston arrangement covers and releases the first opening and the second opening.

9. The pressure intensifier according to claim 8, wherein both openings are closed during a part of the movement.

10. The pressure intensifier according to claim 2, wherein a connecting rod is located between the first piston arrangement and the second piston arrangement.

11. The pressure intensifier according to claim 2, wherein a movement of the first piston arrangement in a direction to decrease the volume of the first high pressure chamber is caused by a pressure in the second low pressure chamber and movement of the second piston arrangement in a direction to decrease the volume of the second high pressure chamber is caused by a pressure in the first low pressure chamber.

12. The pressure intensifier according to claim 3, wherein a movement of the first piston arrangement in a direction to decrease the volume of the first high pressure chamber is caused by a pressure in the second low pressure chamber and movement of the second piston arrangement in a direction to decrease the volume of the second high pressure chamber is caused by a pressure in the first low pressure chamber.

13. The pressure intensifier according to claim 4, wherein a movement of the first piston arrangement in a direction to decrease the volume of the first high pressure chamber is caused by a pressure in the second low pressure chamber and movement of the second piston arrangement in a direction to decrease the volume of the second high pressure chamber is caused by a pressure in the first low pressure chamber.

14. The pressure intensifier according to claim 2, wherein, in any switching position of the switching valve, a space between the first piston arrangement and the second piston arrangement is connected to a tank port (T).

15. The pressure intensifier according to claim 3, wherein, in any switching position of the switching valve, a space between the first piston arrangement and the second piston arrangement is connected to a tank port (T).

16. A double acting hydraulic pressure intensifier comprising a housing, a first piston arrangement having a first high pressure piston in a first high pressure chamber in the housing and a first low pressure piston in a first low pressure chamber of the housing, a second piston arrangement, having a second high pressure piston in a second high pressure chamber in the housing and a second low pressure piston in a second low pressure chamber in the housing, and a switching valve having a valve element, wherein the switching valve is located between the first piston arrangement and the second piston arrangement, wherein the valve element comprises a first pressure area arrangement and a second pressure area arrangement, wherein an effective area of the first pressure area arrangement is larger than an effective area of the second pressure area arrangement, the second pressure area arrangement is permanently loaded by a first pressure and the first pressure area arrangement is alternatively loaded by the first pressure and by a second pressure smaller than the first pressure.

17. The pressure intensifier according to claim 16, wherein the housing comprises a switching channel connected to the first pressure area arrangement, wherein the switching channel has a first opening connectable to the first pressure and a second opening connectable to the second pressure, wherein upon movement the first piston arrangement covers and releases the first opening and the second opening.

18. The pressure intensifier according to claim 17, wherein both openings are closed during a part of the movement.

19. A double acting hydraulic pressure intensifier comprising:

a housing, a first piston arrangement having a first high pressure piston in a first high pressure chamber in the housing and a first low pressure piston in a first low pressure chamber of the housing, a second piston arrangement, having a second high pressure piston in a second high pressure chamber in the housing and a second low pressure piston in a second low pressure chamber in the housing, and a switching valve located in the housing between the first piston arrangement and the second piston arrangement, the switching valve having a valve element having, at least over a part of its length, an outer diameter which is equal to an outer diameter of at least one of the low pressure pistons, wherein the valve element comprises a first pressure area arrangement and a second pressure area arrangement, wherein an effective area of the first pressure area arrangement is larger than an effective area of the second pressure area arrangement, the second pressure area arrangement is permanently loaded by a first pressure and the first pressure area arrangement is alternatively loaded by the first pressure and by a second pressure smaller than the first pressure.

* * * * *